United States Patent [19]

Ingram et al.

[11] 3,964,407

[45] June 22, 1976

[54] SHIFTABLE NEEDLE PLATE

[75] Inventors: Gary L. Ingram, Ooltewah; Jimmie D. Scott, Harrison; Randel P. Smith, Chattanooga, all of Tenn.

[73] Assignee: The Singer Company, New York, N.Y.

[22] Filed: Jan. 12, 1976

[21] Appl. No.: 648,602

[52] U.S. Cl. ..... 112/79 R

[51] Int. Cl.[2] ..... D05C 15/30

[58] Field of Search ..... 112/79 A, 79 R, 79 FF, 112/78, 79.5, 218, 260

[56] References Cited

UNITED STATES PATENTS 3,301,205 1/1967 Card ..... 112/79 R 3,577,943 5/1971 Watkins ..... 112/79 R

*Primary Examiner*—H. Hampton Hunter

*Attorney, Agent, or Firm*—Edward L. Bell; Robert E. Smith; Alan Ruderman

[57] ABSTRACT

A tufting machine having a needle plate supported for lateral movement relative to the needles. The needle plate may be shifted laterally in accordance with a pattern. The support for the needle plate includes a pair of laterally extending rods movable in bearing members secured to the tufting machine. Picker rolls on the leading edge of the needle plate provide a positive gripping action between the backing fabric and the needle plate during the shifting movements.

2 Claims, 5 Drawing Figures

Fig. 2
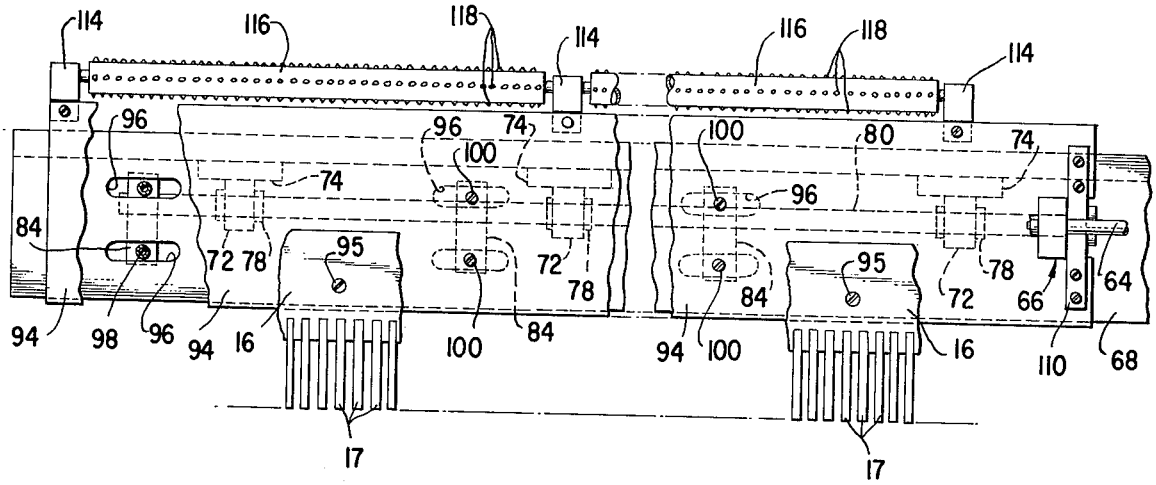
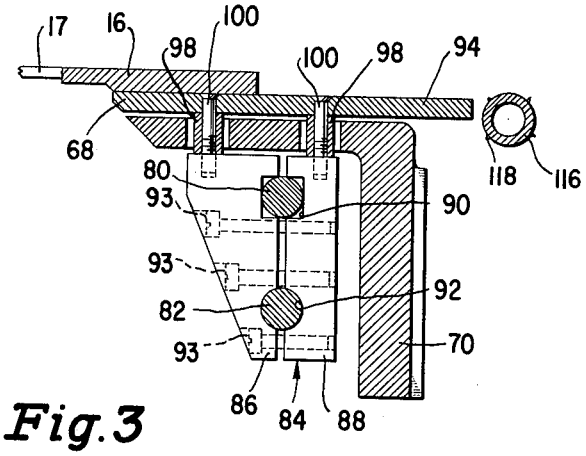
Fig. 3
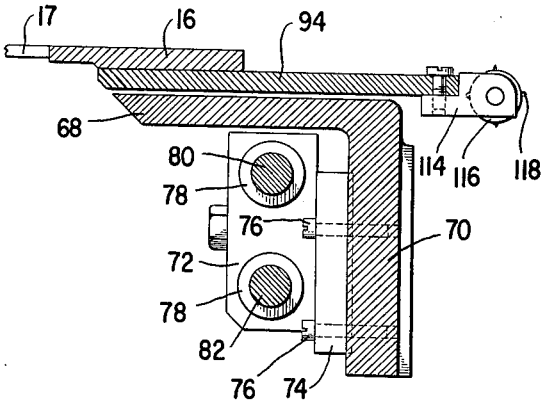
Fig. 4
Fig. 5
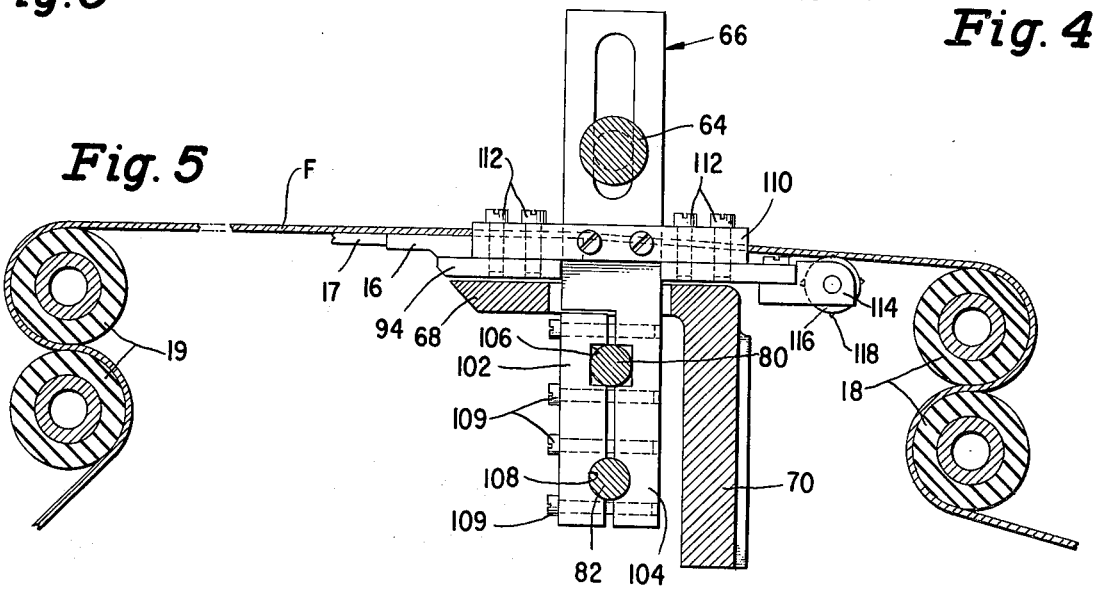

SHIFTABLE NEEDLE PLATE

BACKGROUND OF THE INVENTION

This invention relates to tufting machines and more particularly to a tufting machine having an improved slidable needle plate for shifting the backing fabric laterally to laterally displace the individual yarn ends between the various longitudinal rows.

The art of tufting incorporates a plurality of yarn carrying spaced needles extending transversely across the machine and reciprocated cyclically to penetrate and insert pile into a backing fabric fed longitudinally beneath the needles. During each penetration of the backing fabric a row of pile is produced transversely across the backing. Successive penetrations result in a longitudinal row of pile produced by each needle. This basic method of tufting limits the aesthetic appearance of tufted carpet so produced.

Methods have been devised which effect relative shifting between the needles and the backing fabric which provide patterning capabilities and which break-up the noticeable alignment of the longitudinal rows that detract from the appearance of the carpet. Moreover, when using yarns of different color and different needles the shifting selectively transfers yarns of one color into a row normally having a different color. One such method is illustrated in U.S. Pat. of Card, No. 3,301,205 which provides a needle plate supported for movement laterally of the machine and provides a cam operated linkage for shifting the needle plate in accordance with a pattern. Needle plate fingers are provided to secure the backing fabric to the needle plate for lateral movement while allowing longitudinal movement of the fabric over the needle plate and fingers. It has now been found that the grip provided by this construction especially when the newer backing fabric materials are used is not sufficient enough to obtain more than very limited lateral movement of the backing when the needle plate is shifted laterally. Moreover since the prior slidable needle plate support construction provided a gib bearing between the needle plate and the bed plate rail, additional limitations as to rigidity and sliding friction limit the extent of needle plate shifting.

SUMMARY OF THE INVENTION

In order to improve the gripping characteristics of the sliding needle plate so that a more positive shifting of the backing fabric is obtained, the present invention provides a slidably mounted needle plate having bearing blocks for supporting a picker roll over which the backing is fed. The picker roll shifts with the needle plate and positively grips the backing to shift the same therewith. Moreover, the rigidity of the needle plate support structure is improved and the frictional forces opposing the lateral shifting of the needle plate are reduced by supporting the needle plate by rod members mounted for lateral movement in ball bushings.

Accordingly, it is a primary object of this invention to provide a tufting machine having a lateral shiftable needle plate a more positive gripping action between the needle plate and the backing fabric.

It is another object of this invention to provide a tufting machine including a laterally shiftable needle plate having reduced friction forces opposing the lateral movement and which is rigidly supported.

BRIEF DESCRIPTION OF THE DRAWINGS

Other objects and advantages of this invention will best be understood upon reading the following detailed description of the invention with the accompanying drawings, in which:

FIG. 2 is a fragmentary top plan view of the needle plate illustrated in FIG. 1 partly broken away;

FIG. 3 is a cross-sectional view through the needle plate construction taken substantially along line 3—3 of FIG. 1;

FIG. 4 is a sectional view taken substantially along line 4—4 of FIG. 1; and FIG. 5 is a cross-sectional view taken substantially along line 5—5 of FIG. 1.

DETAILED DESCRIPTION OF THE PREFERRED EMBODIMENT

Figure 1:
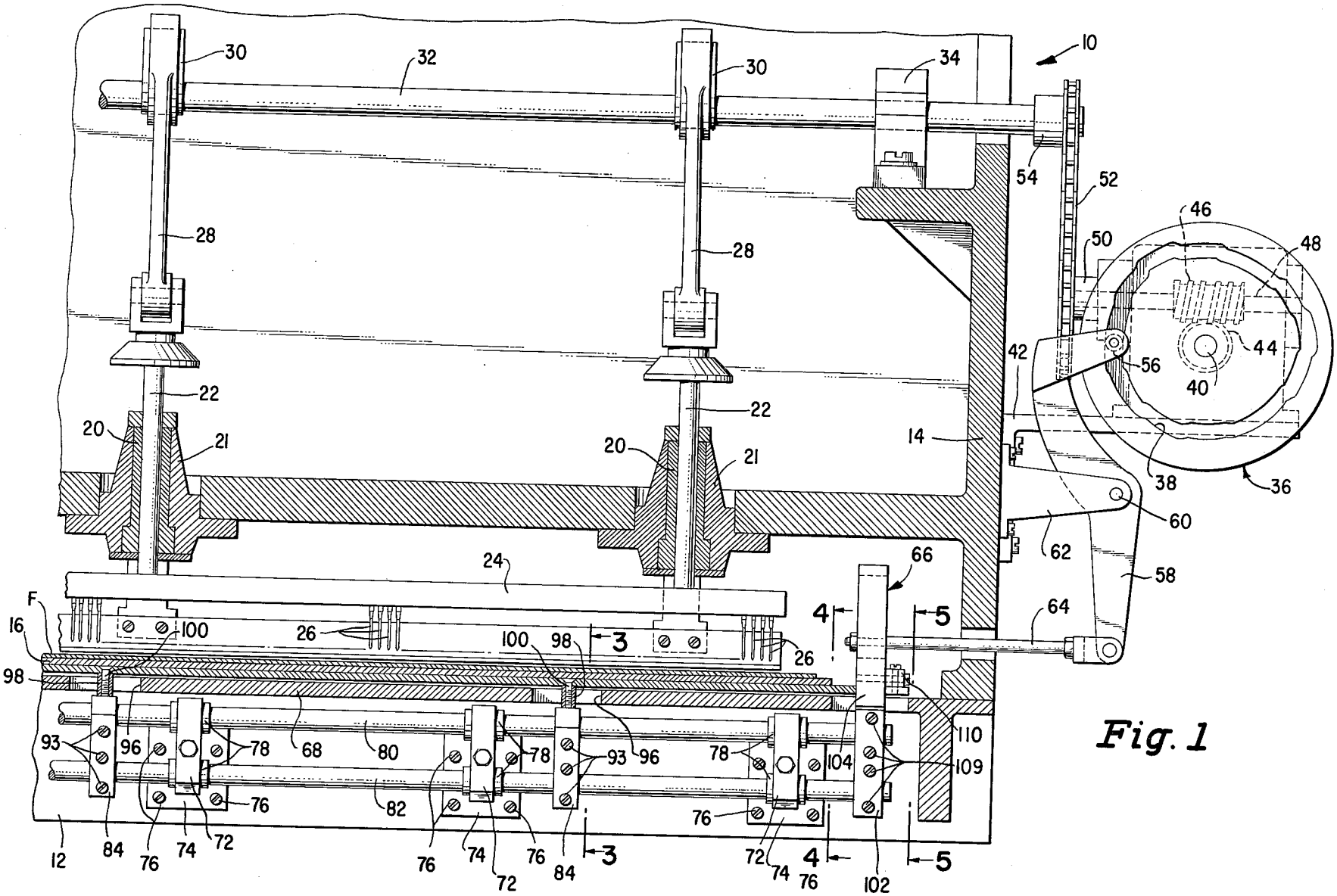
FIG. 1 is a fragmentary sectional view through a tufting machine having a needle plate constructed in accordance with the present invention.

Referring now to the drawings there is illustrated a portion of a tufting machine having a generally conventional frame 10 having a bed 12 and a head 14 disposed above the bed. The bed 12 includes a needle plate 16 having a plurality of fingers 17 extending from the trailing edge over which a backing fabric F is adapted to be fed in a conventional manner such as front and rear feed rollers 18 and 19.

Mounted in the head 14 for vertical reciprocation within bushings 20 of collar assemblies 21 is two of a plurality of push rods 22 to the lower end of which is secured a needle bar 24 which carries a plurality of transversely extending needles 26 that are adapted to penetrate the fabric F on the needle plate 16 upon reciprocation of the needle bar. Endwise reciprocation is imparted to the push rods 22 and thus the needle bar 24 and the needles 26 by a link 28 which is pivotably connected at its lower end to the push rods 22 and at its upper end to an eccentric 30 on a driven rotary main shaft 32 that is journalled longitudinally in bearing blocks 34 mounted in the head 14. Although not illustrated, a plurality of hooks adapted to cooperate individually with one of the needles to seize a loop of yarn presented by the needle and to hold the same as the needle is withdrawn is conventionally mounted for oscillating motion beneath the needle plates 16. A looper construction of this type is illustrated in the aforesaid patent of Card.

As hereinafter described the needle plate 16 is mounted for sliding movement laterally of the machine and is driven in accordance with a pattern in timed relation with the reciprocation of the needles. To this end the patterning device illustrated in the aforesaid Card patent may be utilized. Thus, a cam 36 having a cam track 38 may be mounted on a shaft 40 journalled on a bracket 42 on the head 14. The cam 36 is rotated by a worm wheel 44 on the shaft 40 and driven by a worm 46 on a counter-shaft 48 journalled in the bracket 42. A sprocket 50 is secured to one end of the counter-shaft 48 and is driven by a chain 52 trained about the sprocket 50 and a sprocket 54 on the corresponding end of the main snaft 32 of the machine. Positioned within the cam track 38 is a follower member 56 in the form of a stud pivotably mounted on the upper end of a lever 58 that is pivotably mounted intermediate its ends at 60 on a bracket 62 secured to the head 14 of the machine. The other end of the lever 58 is pivotably connected to one end of a drive rod 64 having its other end extending inwardly over the bed and secured to a drive arm clamp member 66.

Mounted in the bed 12 to the frame of the tufting machine is a horizontally disposed bed plate 68 including a substantially vertically disposed leg defining a bed plate rail 70. A plurality of spaced bearing blocks 72 having mounting plates 74 are secured to the bed plate rail 70 by conventional means such as screws 76. Each of the bearing blocks 72 preferably has a pair of vertically spaced laterally disposed bores which are fitted with respective ball bushings 78 which are linear ball bearings. The upper bushings are all aligned with each other laterally as are the lower bushings for receiving respective upper and lower rods 80 and 82.

Spaced apart at intervals along the rods 80 and 82 are a number of clamping blocks 84 which preferably comprise two members 86 and 88 each having a complementary half of rod receiving apertures 90 and 92. The members 86 and 88 are clamped together by means of screws 93 about the rod so that blocks are secured to the rods for movement therewith. The clamping members are sized so that the tops thereof are spaced below the bed plate. Mounted above the bed plate 68 is a support plate 94 to which the needle plate 16 is secured by means such as screws 95. The bed plate in the vicinity of each clamping block 84 includes laterally elongated apertures 96, preferably two such apertures spaced apart in the longitudinal direction of feed of fabric F. Mounted in each aperture 96 is a spacer 98 for receiving a screw 100 which extends from the support plate 94 and is threaded into each member 86 and 88 of the clamping blocks 84. This spacer is longer than the thickness of the bed plate so that the plate 94 is spaced above the bed plate. Thus, the support plate 94 is secured to the clamping blocks 84 for movement therewith free of contact with the bed plate. The lateral dimensions of the slots 96 are such that as to be interference free with the spacers when the rods 80 and 82 are shifted.

The rods 80 and 82 are secured to the drive arm 66 by means similar to that of the clamping block. The drive arm 66 includes a clamping member 102 adapted to be secured to a portion 104 of the arm 66 below the bed plate in the vertical vicinity of the rods. The member 102 and the portion 104 of the arm 66 each have a complementary half of rod receiving apertures 106 and 108 and are clamped together by means of screws 109 about the rods 80 and 82. Thus, the movement imparted by cam 36 through the follower 56, the lever 58 and the drive rod 64 is transmitted to the rods 80 and 82 by the drive arm 66, and from the rods to support plate 94 and needle plate 16. Moreover, a connecting bar 110 is secured to the drive arm 66 above the bed plate and is further secured to the support plate 94 by screws 112 to provide an additional motion input to the support plate. This construction thus provides a rigid assembly while minimizing the frictional forces, since the support plate 94 on which the needle plate is fixed does not contact the bed plate 68.

In order to provide a positive gripping of the backing fabric F, so when the needle plate is shifted laterally the backing will follow, the assembly includes a plurality of laterally spaced bearing blocks 114 secured to the front of the support plate 94. Journalled in the bearing blocks 114 and positioned between each pair of blocks is a picker roll 116 having a multiplicity of pins or picks 118. Although the bearing blocks 114, and therefore the rolls 116 are preferably secured to the support plate 94 for economical reasons, it should be clear that they could be secured to the needle plate at the side remote from the fingers 17. In any event, the rollers are movable with the needle plate and its fingers.

Numerous alterations of the structure herein disclosed will suggest themselves to those skilled in the art. However, it is to be understood that the present disclosure relates to a preferred embodiment of the invention which is for purposes of illustration only and not to be construed as a limitation of the invention. All such modifications which do not depart from the spirit of the invention are intended to be included within the scope of the appended claims.

Having thus described the nature of the invention, what we claim herein is:

1. In a tufting machine having a plurality of needles arranged substantially in a row laterally across the machine, a needle plate for supporting a backing fabric relative to said needles, means for feeding the backing fabric longitudinally of the machine over the needle plate, means for actuating said needles for penetrating said backing fabric to insert loops of yarn therein upon each penetration of the needles, and patterning means for shifting the needle plate and backing fabric laterally of the machine and relatively to the needles comprising: a plurality of laterally spaced bearing blocks secured to the machine below the needle plate, a plurality of spaced linear bearings in each bearing block, each bearing in each block being aligned with a corresponding bearing in the other blocks, a rod received in corresponding bearings of each block, clamping means for securing said rods to the needle plate, means for imparting lateral movement to the rods in accordance with a pattern, and laterally extending roller means including means supporting said roller means for rotation relative to and for movement with the needle plate, said roller means including a multiplicity of picks for engaging the backing fabric.

2. In a tufting machine having patterning means as recited in claim 1 wherein said roller means comprises a plurality of rollers, said rollers being positioned longitudinally forward of the needles relatively to the direction of backing fabric feed.

* * * * *